US010435762B2

(12) United States Patent
Takashima et al.

(10) Patent No.: US 10,435,762 B2
(45) **Date of Patent: *Oct. 8, 2019**

(54) HIGH-YIELD-RATIO HIGH-STRENGTH COLD-ROLLED STEEL SHEET AND METHOD OF PRODUCING THE SAME

(71) Applicant: JFE Steel Corporation, Tokyo (JP)

(72) Inventors: Katsutoshi Takashima, Chiba (JP); Yoshihiko Ono, Fukuyama (JP); Kohei Hasegawa, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 278 days.

This patent is subject to a terminal disclaimer.

(21) Appl. No.: 15/129,938

(22) PCT Filed: Mar. 13, 2015

(86) PCT No.: PCT/JP2015/001401

§ 371 (c)(1),
(2) Date: Sep. 28, 2016

(87) PCT Pub. No.: WO2015/151419

PCT Pub. Date: Oct. 8, 2015

(65) Prior Publication Data

US 2017/0145534 A1 May 25, 2017

(30) Foreign Application Priority Data

Mar. 31, 2014 (JP) ..... 2014-070954

(51) Int. Cl.

| | |
|---|---|
| ***C21D 9/46*** | (2006.01) |
| ***C21D 8/02*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/18*** | (2006.01) |
| ***C22C 38/28*** | (2006.01) |
| ***C22C 38/32*** | (2006.01) |
| ***C22C 38/38*** | (2006.01) |
| ***C22C 38/00*** | (2006.01) |

(52) U.S. Cl.

CPC ..... *C21D 9/46* (2013.01); *C21D 8/0226* (2013.01); *C21D 8/0236* (2013.01); *C21D 8/0263* (2013.01); *C21D 8/0278* (2013.01); *C22C 38/00* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/18* (2013.01); *C22C 38/28* (2013.01); *C22C 38/32* (2013.01); *C22C 38/38* (2013.01); *C21D 8/0273* (2013.01); *C21D 2211/001* (2013.01); *C21D 2211/002* (2013.01); *C21D 2211/005* (2013.01); *C21D 2211/008* (2013.01)

(58) Field of Classification Search

None

See application file for complete search history.

(56) References Cited

U.S. PATENT DOCUMENTS

| | | | | |
|---|---|---|---|---|
| 10,156,005 | B2 * | 12/2018 | Takashima | C22C 38/14 |
| 2008/0251161 | A1 | 10/2008 | Kashima et al. | |
| 2011/0186189 | A1 | 8/2011 | Futamura | |
| 2013/0087257 | A1 * | 4/2013 | Yoshino | C21D 9/46 148/648 |
| 2013/0133792 | A1 * | 5/2013 | Nakagaito | C21D 9/46 148/645 |

(Continued)

FOREIGN PATENT DOCUMENTS

| | | |
|---|---|---|
| CA | 2 850 462 | 4/2013 |
| CN | 101558178 | 10/2009 |

(Continued)

OTHER PUBLICATIONS

"X-ray Diffraction Handbook", *Rigaku Denki Co., Ltd.*, 2000, pp. 26 and 62-64 along with a partial English translation.

Extended European Search Report dated Mar. 16, 2017, of corresponding European Application No. 15773235.5.

Japanese Office Action dated Nov. 4, 2015, of corresponding Japanese Application No. 2015-531381, along with a Concise Statement of Relevance of Office Action in English.

Chinese Office Action dated May 4, 2017 of corresponding Chinese Application No. 201580017845.4, along with a Concise Statement of Relevance of Office Action in English.

(Continued)

*Primary Examiner* — Helene Klemanski

(74) *Attorney, Agent, or Firm* — DLA Piper LLP (US)

(57) ABSTRACT

A high-strength cold-rolled steel sheet has a composite structure containing 0.15 to 0.25% by mass of C, 1.8 to 3.0% by mass of Mn, and 0.0003 to 0.0050% by mass of B, and having a ferrite volume fraction of 20% to 50%, a retained austenite volume fraction of 7% to 20%, a martensite volume fraction of 1% to 8%, and the balance containing bainite and tempered martensite, and in the composite structure, ferrite has an average crystal grain diameter of 5 μm or less, retained austenite has an average crystal grain diameter of 0.3 to 2.0 μm and an aspect ratio of 4 or more, martensite has an average crystal grain diameter of 2 μm or less, a metal phase containing both bainite and tempered martensite has an average crystal grain diameter of 7 μm or less, the ratio of the volume fraction of tempered martensite to the volume fraction of a metal structure other than ferrite is 0.60 to 0.85, and the average C concentration in retained austenite is 0.65% by mass or more.

8 Claims, No Drawings

(56) References Cited

U.S. PATENT DOCUMENTS

| | | | | |
|---|---|---|---|---|
| 2014/0000765 | A1* | 1/2014 | Nozaki | C21D 8/0226 148/504 |
| 2014/0234660 | A1* | 8/2014 | Kawata | C21D 9/46 428/659 |
| 2014/0322559 | A1* | 10/2014 | Becker | C22C 38/02 428/659 |
| 2014/0342184 | A1* | 11/2014 | Takagi | C22C 38/001 428/659 |
| 2015/0034219 | A1 | 2/2015 | Kawabe et al. | |
| 2015/0086808 | A1 | 3/2015 | Kasuya et al. | |
| 2016/0177414 | A1* | 6/2016 | Takashima | C21D 9/46 148/652 |
| 2016/0177427 | A1* | 6/2016 | Takashima | C22C 38/14 148/603 |
| 2017/0022582 | A1* | 1/2017 | Takashima | C22C 38/02 |
| 2017/0107591 | A1* | 4/2017 | Takashima | C21D 9/46 |
| 2017/0321297 | A1* | 11/2017 | Takashima | C21D 9/46 |

FOREIGN PATENT DOCUMENTS

| | | | |
|---|---|---|---|
| CN | 101724776 | | 6/2010 |
| CN | 105452513 | | 3/2016 |
| EP | 2 182 080 | A1 | 5/2010 |
| EP | 2 258 886 | | 12/2010 |
| EP | 2 524 970 | | 11/2012 |
| EP | 2 530 179 | | 12/2012 |
| EP | 2 692 895 | | 2/2014 |
| EP | 2 762 582 | | 8/2014 |
| EP | 2 762 589 | | 8/2014 |
| EP | 3 012 339 | A1 | 4/2016 |
| JP | 2009-256773 | | 11/2009 |
| JP | 2010-059452 | A | 3/2010 |
| JP | 4716358 | B2 | 7/2011 |
| JP | 2011-157583 | A | 8/2011 |
| JP | 4925611 | B2 | 5/2012 |
| JP | 2013-185196 | A | 9/2013 |
| JP | 2013-185247 | A | 9/2013 |
| JP | 2013-227654 | A | 11/2013 |
| WO | 2008/072866 | A1 | 6/2008 |
| WO | 2013/047755 | | 4/2013 |
| WO | 2013/047821 | | 4/2013 |
| WO | WO 2015/019557 | A1 * | 2/2015 |
| WO | WO 2016/092733 | A1 * | 6/2016 |

OTHER PUBLICATIONS

Official Action dated Jan. 12, 2018, of related U.S. Appl. No. 14/911,088.

Official Action dated Jun. 5, 2018, of related U.S. Appl. No. 14/911,088.

* cited by examiner

HIGH-YIELD-RATIO HIGH-STRENGTH COLD-ROLLED STEEL SHEET AND METHOD OF PRODUCING THE SAME

TECHNICAL FIELD

This disclosure relates to a high-strength cold-rolled steel sheet having a high yield ratio and a method of producing the same and, particularly, relates to a thin steel sheet suitable as a structural member for automobiles and the like. The yield ratio (YR) is a value indicating a ratio of yield stress (YS) to tensile strength (TS) and is represented by YR=YS/TS.

BACKGROUND

In the automotive field in which improvement in fuel consumption with weight reduction of car bodies is becoming an important issue, thinning of high-strength steel sheets applied to automobile parts is advanced, and use of steel sheets with a TS of 980 MPa or more is advanced.

High-strength steel sheets used for automobile structural members and reinforcing members are required to have excellent formability and impact energy absorption properties. In forming parts having a complicated shape, the steel sheets are required to be not only excellent in respective characteristics such as excellent elongation and stretch flangeability (hole expansion formability), but also excellent in both characteristics and, particularly, an elongation of 20% or more is required to form parts that are required to be bent. Also, to improve impact energy absorption property, it is effective to enhance the yield ratio, and impact energy can be effectively absorbed even with a small strain.

A dual phase steel sheet (DP steel sheet) having a ferrite-martensite structure has been known as a high-strength thin steel sheet having both formability and high strength. However, the DP steel sheet has excellent elongation with strength, but cracks easily occur due to the concentration of stress in a ferrite-martensite interface, thereby causing the disadvantage of low bendability and hole expansion formability. Therefore, for example, Japanese Patent No. 4925611 discloses a DP steel sheet with excellent elongation and bendability imparted by controlling the crystal grain diameter, volume fraction, and nano-hardness of ferrite. Also, a TRIP steel sheet is known as a steel sheet having both high strength and excellent ductility. TRIP steel sheet has a steel sheet structure containing retained austenite, and working deformation at a temperature equal to or higher than the martensite transformation start temperature causes stress-induced transformation of the retained austenite to martensite, producing large elongation. However, the TRIP steel sheet causes transformation of the retained austenite to martensite during punching and thus cracks occur at an interface with ferrite, thereby causing the disadvantage of low hole expansion formability. Therefore, Japanese Patent No. 4716358 discloses a TRIP steel sheet containing bainitic ferrite.

However, in general, moving dislocation is introduced in ferrite in a DP steel sheet during martensite transformation and, thus, the yield ratio is decreased, thereby decreasing the impact energy absorption property. Also, the steel sheet of Japanese Patent No. 4925611 has insufficient elongation with a tensile strength (TS) of 980 MPa or more, and satisfactory formability cannot be secured. Further, in having a tensile strength (TS) of 980 MPa or more, the steel sheet of Japanese Patent No. 4716358 utilizing retained austenite has a yield ratio (YR) of less than 75% and, thus, has the low impact energy absorption property. Therefore, it is difficult for a high-strength steel sheet having a tensile strength (TS) of 980 MPa or more to secure elongation and hole expansion formability that achieves excellent press formability, while excellent impact energy absorption property is maintained. In an actual situation, including other steel sheets, there have not been developed steel sheets that satisfy these characteristics (yield ratio, strength tensile strength, elongation, and hole expansion formability).

Accordingly, it could be helpful to provide a high-strength cold-rolled steel sheet having excellent elongation and hole expansion formability and a high yield ratio and a method of producing the steel sheet.

SUMMARY

We thus provide:

[1] A high-yield-ratio high-strength cold-rolled steel sheet having a steel composition containing, by % by mass, 0.15 to 0.25% of C, 1.2 to 2.2% of Si, 1.8 to 3.0% of Mn, 0.08% or less of P, 0.005% or less of S, 0.01 to 0.08% of Al, 0.007% or less of N, 0.005 to 0.050% of Ti, 0.0003 to 0.0050% of B, and the balance composed of Fe and inevitable impurities, wherein the steel sheet has a composite structure having a ferrite volume fraction of 20% to 50%, a retained austenite volume fraction of 7% to 20%, a martensite volume fraction of 1% to 8%, and the balance containing bainite and tempered martensite, and in the composite structure, ferrite has an average crystal grain diameter of 5 μm or less, retained austenite has an average crystal grain diameter of 0.3 to 2.0 μm and an aspect ratio of 4 or more, martensite has an average crystal grain diameter of 2 μm or less, a metal phase containing both bainite and tempered martensite has an average crystal grain diameter of 7 μm or less, the volume fraction (V1) of metal structures other than ferrite and the volume fraction (V2) of tempered martensite satisfy expression (1), and the average C concentration in retained austenite is 0.65% by mass or more.

$$0.60 \leq V2/V1 \leq 0.85 \quad (1)$$

[2] The high-yield-ratio high-strength cold-rolled steel sheet [1] further contains, by % by mass, at least one selected from 0.10% or less of V, 0.10% or less of Nb, 0.50% or less of Cr, 0.50% or less of Mo, 0.50% or less of Cu, 0.50% or less of Ni, 0.0050% or less of Ca, and 0.0050% or less of REM.

[3] A method of producing a high-yield-ratio high-strength cold-rolled steel sheet including hot-rolling a steel slab having the chemical composition [1] or [2] under the conditions including a hot-rolling start temperature of 1150° C. to 1300° C. and a finishing temperature of 850° C. to 950° C.; starting cooling within 1 second after the finish of hot rolling and performing primary cooling to 650° C. or less at an average cooling rate of 80° C./s or more and then performing secondary cooling to 550° C. or less at an average cooling rate of 5° C./s or more; and coiling, pickling, cold-rolling, and then continuously annealing the steel sheet, wherein the continuous annealing includes heating to a temperature range of 750° C. to 850° C. at an average heating rate of 3 to 30° C./s, holding in the temperature range of 750° C. to 850° C. for 30 seconds or more, cooling to a cooling stop temperature range of 100° C. to 250° C. at an average cooling rate of 3° C./s or more, then heating to a temperature range of 350° C. to 500° C., holding in the temperature range of 350° C. to 500° C. for 30 seconds or more, and then cooling to room temperature.

The "high-strength cold-rolled steel sheet" represents a cold-rolled steel sheet having a tensile strength (TS) of 980 MPa or more. The "high yield ratio" represents a yield ratio (YR) of 75% or more.

Also, the "average cooling rate" represents a value obtained by subtracting the cooling finish temperature from the cooling start temperature and dividing the result of subtraction by the cooling time. The average heating rate represents a value obtained by subtracting the heating start temperature from the heating finish temperature and dividing the result of subtraction by the heating time.

A high-strength cold-rolled steel sheet has a tensile strength of 980 MPa or more, a high yield ratio of 75% or more, and an elongation of 20.0% or more and a hole expansion ratio of 35% or more and thus has excellent elongation and hole expansion formability.

Also, our production method can stably produce the high-strength cold-rolled steel sheet having excellent performance.

DETAILED DESCRIPTION

We found that a high-strength steel sheet having high ductility and excellent hole expansion formability while maintaining a high yield ratio can be produced by controlling, with a specified steel composition, the volume fractions of ferrite, retained austenite, and martensite to specified ratios in a metal structure of the steel sheet, controlling the average crystal grain diameters of ferrite, martensite, retained austenite, bainite, and tempered martensite, the aspect ratio of retained austenite, and the ratio of the tempered martensite in a hard phase, and further controlling the C concentration in the retained austenite to secure an elongation of 20% or more.

In a hole expansion test, when martensite or retained austenite having high hardness is present in a steel sheet structure, voids occur in an interface, particularly an interface with soft ferrite, during punching, and the voids are connected to each other and grown in a subsequent hole expansion process, thereby producing cracks. On the other hand, when the steel sheet structure contains soft ferrite and retained austenite, elongation is improved. Also, when the steel sheet structure contains bainite and tempered martensite with a high dislocation density, the yield ratio is increased, but the effect on elongation is small. Therefore, it has been difficult to improve the balance between elongation and high yield ratio.

We found that the occurrence of voids during punching and the connection of voids during hole expansion can be suppressed by adjusting the volume fractions of a soft phase and a hard phase, which serve as a void source, allowing the retained austenite contained to have a fine crystal form with a high aspect ratio, and increasing the C concentration in the retained austenite to make the retained austenite stable without causing martensite transformation even after punching so that the occurrence of voids during punching and the connection of voids during hole expansion can be suppressed. An improved elongation and a high yield ratio can also be achieved while maintaining strength (tensile strength) and hole expansion formability. Further, the excessive addition of a hardening element increases the hardness of tempered martensite and martensite and thus degrades hole expansion formability. Therefore, by adding B, hardenability can be secured without increasing the hardness of tempered martensite and martensite. Further, by adding B, formation of ferrite and pearlite can be suppressed during cooling after finish rolling in hot rolling. In addition, a range causing refining of the average crystal grain diameter of martensite and improvement in hole expansion formability is clarified by the ratio of the tempered martensite in the hard phase.

Therefore, we found that in a hot-rolled steel sheet containing appropriate amounts of C, Mn, and B and having a bainite homogeneous structure as a steel sheet structure, the ratio of tempered martensite can be controlled by controlling the cooling stop temperature and soaking holding conditions after cooling during subsequent continuous annealing, and the average crystal grain diameter, aspect ratio, C concentration of retained austenite can be controlled in the process of bainite transformation during cooling or soaking holding after cooling, and thus our steel sheet structure can be formed.

Thus, when C is within 0.15% to 0.25% by mass, Mn is within 1.8% to 3.0% by mass, B is within 0.0003% to 0.0050% by mass, and heat treatment is performed under appropriate hot-rolling and annealing conditions, the volume fraction, average crystal grain diameter, aspect ratio, and C concentration of retained austenite sufficient to secure elongation and hole expansion formability can be controlled while refining the crystal grain diameters of ferrite and martensite, and elongation and hole expansion formability can be improved while securing a high yield ratio by controlling the volume fractions of ferrite, bainite, tempered martensite, and martensite within a range where strength and ductility are not impaired.

First, the steel composition of a high-strength cold-rolled steel sheet is described. In description below, "%" shown in a steel composition represents "% by mass".

The high-strength cold-rolled steel sheet has a steel composition containing, by % by mass, 0.15 to 0.25% of C, 1.2 to 2.2% of Si, 1.8 to 3.0% of Mn, 0.08% or less of P, 0.005% or less of S, 0.01 to 0.08% of Al, 0.007% or less of N, 0.005 to 0.050% of Ti, 0.0003 to 0.0050% of B, and, if required, further containing at least one selected from 0.10% or less of V, 0.10% or less of Nb, 0.50% or less of Cr, 0.50% or less of Mo, 0.50% or less of Cu, 0.50% or less of Ni, 0.0050% or less of Ca, and 0.0050% or less of REM, the balance composed of Fe and inevitable impurities.

C: 0.15 to 0.25%

C is an element effective in increasing strength, contributes to formation of second phases of bainite, tempered martensite, retained austenite, and martensite, and is particularly effective in increasing the C concentration in retained austenite. The C content of less than 0.15% causes difficulty in securing the volume fractions of required bainite, tempered martensite, retained austenite, and martensite and in securing the C concentration in retained austenite. Therefore, the C content is 0.15% or more. The C content is preferably 0.17% or more. On the other hand, when C is excessively contained, a hardness difference between ferrite, tempered martensite, and martensite is increased, thereby decreasing hole expansion formability. Thus, the C content is 0.25% or less. The C content is preferably 0.23% or less.

Si: 1.2 to 2.2%

Si is an element contributing to formation of retained austenite by suppressing formation of carbide during bainite transformation and being necessary to secure an aspect ratio of retained austenite. To sufficiently form retained austenite, 1.2% or more of Si is required to be contained, and the Si content is preferably 1.3% or more. However, an excessive Si content decreases chemical convertibility, and thus the Si content is 2.2% or less.

Mn: 1.8 to 3.0%

Mn is an element contributing to an increase in strength by facilitating formation of a second phase under solid-solution strengthening. Also, Mn is an element that stabilizes austenite and is an element necessary to control the fraction of the second phase. Further, Mn is an element necessary to homogenize the structure of the hot-rolled steel sheet by bainite transformation. It is necessary to contain 1.8% or more of Mn to obtain the desired effect. On the other hand, when Mn is excessively contained, the volume fraction of martensite becomes excessive, and further the hardness of martensite and tempered martensite is increased, thereby degrading hole expansibility. Therefore, the Mn content is 3.0% or less. The Mn content is preferably 2.8% or less and more preferably 2.5% or less.

P: 0.08% or less

P contributes to an increase in strength by solid-solution strengthening, but since an excessive P content causes embrittlement of grain boundaries due to significant segregation in the grain boundaries and decreases weldability, the Mn content is 0.08% or less. The P content is preferably 0.05% or less.

S: 0.005% or less

Since at a high S content, local elongation represented by stretch flangeability is decreased due to production of a large amount of sulfide such as MnS, the upper limit of the S content is 0.005%. The S content is preferably 0.0045% or less. Although the lower limit is not particularly limited, the lower limit of the S content is preferably about 0.0005% because extremely low S increases the steelmaking cost.

Al: 0.01 to 0.08%

Al is an element necessary for deoxidation, and an Al content necessary to obtain the desired effect is 0.01% or more, but the Al content is 0.08% or less because the effect is saturated even when over 0.08% of Al is contained. The Al content is preferably 0.05% or less.

N: 0.007% or less

The N content is required to be suppressed because N forms a coarse nitride and degrades bendability and stretch flangeability. This effect becomes remarkable at the N content exceeding 0.007%, and thus the N content is 0.007% or less. The N content is preferably 0.005% or less.

Ti: 0.005 to 0.050%

Ti is an element that can contribute to an increase in strength by forming a fine carbonitride. Further, Ti is necessary to prevent B that is an essential element from reacting with N. The Ti content is required to be 0.005% or more to exhibit the desired effect. The Ti content is preferably 0.008% or more. On the other hand, the high Ti content significantly decreases elongation, and thus the Ti content is 0.050% or less. The Ti content is preferably 0.030% or less.

B: 0.0003 to 0.0050%

B is an element that improves hardenability, contributes to an increase in strength by facilitating formation of a second phase, and prevents a significant increase in hardness of martensite and tempered martensite while maintaining hardenability. Further, B has the effect of suppressing formation of ferrite and pearlite during cooling after finish rolling in hot rolling. The B content required to exhibit the desired effect is 0.0003% or more. On the other hand, the effect is saturated even when the B content exceeds 0.0050%, and thus the B content is 0.0050% or less. The B content is preferably 0.0040% or less.

If required, one or more components described below may be contained in addition to the components described above.

V: 0.10% or less

V can contribute to an increase in strength by forming a fine carbonitride, and thus can be contained according to demand. The V content is preferably 0.01% or more to exhibit the desired effect. On the other hand, even when a large amount of V is contained, an excess over 0.10% has the small effect of increasing strength and rather induces an increase in alloy cost. Thus, the V content is preferably 0.10% or less.

Nb: 0.10% or less

Similarly to V, Nb can contribute to an increase in strength by forming a fine carbonitride, and thus can be contained according to demand. The Nb content is preferably 0.005% or more to exhibit the desired effect. On the other hand, when a large amount of Nb is contained, an elongation is significantly decreased, and thus, the Nb content is preferably 0.10% or less.

Cr: 0.50% or less

Cr is an element that contributes to an increase in strength by facilitating the formation of a second phase, and thus can be contained according to demand. The Cr content is preferably 0.10% or more to exhibit the desired effect. On the other hand, when the Cr content exceeds 0.50%, martensite is excessively formed, and thus the Cr content is preferably 0.50% or less.

Mo: 0.50% or less

Mo is an element that contributes to an increase in strength by facilitating the formation of a second phase and that contributes to an increase in strength by partially forming a carbide, and thus can be contained according to demand. The Mo content is preferably 0.05% or more to exhibit the desired effect. On the other hand, even when the Mn content exceeds 0.50%, the effect is saturated, and thus the Mo content is preferably 0.50% or less.

Cu: 0.50% or less

Cu is an element that contributes to an increase in strength by solid-solution strengthening and also contributes to an increase in strength by facilitating the formation of a second phase, and thus can be contained according to demand. The Cu content is preferably 0.05% or more to exhibit the desired effect. On the other hand, even when the Cu content exceeds 0.50%, the effect is saturated and surface defects due to Cu easily occur, and thus, the Cu content is preferably 0.50% or less.

Ni: 0.50% or less

Similarly to Cu, Ni is an element that contributes to an increase in strength by solid-solution strengthening and also contributes to an increase in strength by facilitating the formation of a second phase, and thus can be contained according to demand. The Ni content is preferably 0.05% or more to exhibit the desired effect. Also, when Ni is contained simultaneously with Cu, there is the effect of suppressing surface defects due to Cu, and thus Ni is effective when Cu is contained. On the other hand, even when the Ni content exceeds 0.50%, the effect is saturated and, thus, the Ni content is preferably 0.50% or less.

Ca: 0.0050% or less, REM: 0.0050% or less

Ca and REM are elements having the effect of decreasing the adverse effect of a sulfide on hole expansion formability by spheroidizing the shape of a sulfide and, thus, can be contained according to demand. The content of each of Ca and REM is preferably 0.0005% or more to exhibit the desired effect. On the other hand, when each of the Ca and REM contents exceeds 0.0050%, the effect is saturated and, thus, each of the contents are preferably 0.0050% or less.

The balance other than the above components contains Fe and inevitable impurities. Examples of inevitable impurities include Sb, Sn, Zn, Co, and the like, and the allowable ranges of the contents thereof are 0.01% or less of Sb, 0.1% or less of Sn, 0.01% or less of Zn, and 0.1% or less of Co. Even when Ta, Mg, and Zr are contained within the range of a usual steel composition, the effect is not lost.

Next, the metal structure of the high-strength cold-rolled steel sheet is described.

The high-strength cold-rolled steel sheet has, as the metal structure, a composite structure having a ferrite volume fraction of 20% to 50%, a retained austenite volume fraction of 7% to 20%, a martensite volume fraction of 1% to 8%, and the balance containing bainite and tempered martensite, and in the composite structure, ferrite has an average crystal grain diameter of 5 μm or less, retained austenite has an average crystal grain diameter of 0.3 to 2.0 μm and an aspect ratio of 4 or more, martensite has an average crystal grain diameter of 2 μm or less, a metal phase containing both bainite and tempered martensite has an average crystal grain diameter of 7 μm or less, the volume fraction (V1) of metal structures other than ferrite (that is, hard phases of bainite, retained austenite, martensite, tempered martensite, pearlite and the like) and the volume fraction (V2) of tempered martensite satisfy expression (1), and the average C concentration in retained austenite is 0.65% by mass or more. The volume fraction of each of the metal phases is a volume fraction relative to the entire steel sheet.

$$0.60 \leq V2/V1 \leq 0.85 \quad (1)$$

When the volume fraction of ferrite is less than 20%, elongation is decreased due to a small amount of soft ferrite, and the ferrite volume fraction is 20% or more. The ferrite volume fraction is preferably 25% or more. On the other hand, when the ferrite volume fraction exceeds 50%, hard second phases are excessively formed, and thus there are many positions having a large difference in hardness from soft ferrite, thereby decreasing hole expansion formability. In addition, it is difficult to secure a tensile strength of 980 MPa or more. Therefore, the ferrite volume fraction is 50% or less. The ferrite volume fraction is preferably 45% or less.

In addition, when ferrite has an average crystal grain diameter exceeding 5 μm, the voids formed at a punched end surface during hole expansion easily connect to each other during hole expansion, and thus good hole expansion formability cannot be obtained. Further, to increase the yield ratio, it is effective to refine the ferrite grain diameter. Therefore, the average crystal grain diameter of ferrite is 5 μm or less.

When the volume fraction of retained austenite is less than 7%, elongation is decreased, and the retained austenite volume fraction is 7% or more to secure good elongation. The retained austenite volume fraction is preferably 9% or more. On the other hand, when the retained austenite volume fraction exceeds 20%, hole expansion formability deteriorates and, thus, the retained austenite volume fraction is 20% or less. The retained austenite volume fraction is preferably 15% or less.

In addition, retained austenite having an average crystal grain diameter of less than 0.3 little contributes to elongation thus has difficulty in securing an elongation of 20% or more. On the other hand, with the average crystal grain diameter within a range exceeding 2.0 μm, voids easily connect to each other after being formed in a hole expansion test. Therefore, the retained austenite average crystal grain diameter is 0.3 to 2.0 μm.

When the retained austenite crystal form has an aspect ratio of less than 4, voids easily connect to each other after being formed in a hole expansion test. Therefore, the retained austenite crystal form has an aspect ratio of 4 or more. The aspect ratio is preferably 5 or more.

Also, when the average C concentration in retained austenite is less than 0.65% by mass, martensite transformation easily occurs during punching in the hole expansion test, and the occurrence of voids is increased, thereby decreasing hole expansion formability. Therefore, the average C concentration in retained austenite is 0.65% by mass or more. The average C concentration is preferably 0.68% by mass or more and more preferably 0.70% by mass or more.

The martensite volume fraction is required to be 1% or more to achieve a tensile strength of 980 NiPa or more while maintaining desired hole expansion formability. On the other hand, the martensite volume fraction is required to be 8% or less for securing good hole expansion formability. Thus, the martensite volume fraction is 1% to 8%.

Also, when martensite has an average crystal grain diameter exceeding 2 μm little, voids formed at an interface with ferrite easily connect, thereby degrading hole expansion formability. Thus, the average crystal grain diameter of martensite is 2 μm or less. In this case, the "martensite" represents martensite produced when austenite remaining untransformed even after holing at a soaking temperature of 350° C. to 500° C. in second soaking during continuous annealing is cooled to room temperature.

It is important that bainite and tempered martensite are present in the metal structure of the steel sheet to achieve a high yield ratio with high strength. In addition, to secure good hole expansion formability and high yield ratio, it is important that the metal structure contains bainite and tempered martensite having an average crystal grain diameter of 7 μm or less. When a metal phase containing both bainite and tempered martensite has an average crystal grain diameter exceeding 7 μm, many voids are produced at interfaces between soft ferrite formed by punching during hole expansion and hard retained austenite and martensite, and the voids produced at the end surface easily connect during hole expansion, thereby failing to achieve good hole expansion formability. Therefore, the metal phase containing both bainite and tempered martensite has an average crystal grain diameter 7 μm or less. The metal phase containing both bainite and tempered martensite preferably has an average crystal grain diameter 6 μm or less.

In addition, the "tempered martensite" represents martensite tempered by heating to a temperature of 350° C. to 500° C. after untransformed austenite is partially transformed to martensite during cooling to a cooling stop temperature (100° C. to 250° C.) in continuous annealing.

Also, the volume fraction (V1) of metal structures other than ferrite (that is, hard phases of bainite, retained austenite, martensite, tempered martensite, and pearlite) and the volume fraction (V2) of tempered martensite satisfy expression (1).

$$0.60 \leq V2/V1 \leq 0.85 \quad (1)$$

The martensite formed during cooling is tempered to tempered martensite during re-heating and subsequent soaking holding, and the presence of tempered martensite accelerates the bainite transformation during soaking holding and, thus, the martensite finally produced during cooling to room temperature can be refined and the volume fraction can be adjusted to a target value. When V2/V1 in expression (1) is less than 0.60, the effect cannot be sufficiently obtained by the tempered martensite, and thus the lower limit of V2/V1 in expression (1) is 0.60. When V2/V1 in expression (1) exceeds 0.85, there is a small amount of untransformed austenite which can be transformed to bainite, and thus sufficient retained austenite cannot be produced, thereby decreasing the elongation. Therefore, the upper limit of V2/V1 in expression (1) is 0.85. The V2/V1 in expression (1) is preferably 0.80 or less.

The metal structure of the cold-rolled steel sheet may contain pearlite in addition to ferrite, retained austenite, martensite, bainite, and tempered martensite, but in this case, the desired effect is not impaired. However, the volume fraction of pearlite is preferably 5% or less.

The volume fraction, average crystal grain diameter, and aspect ratio and average C concentration of retained austenite of each of the metal phases can be measured and calculated by methods described in examples below. Also, the volume fraction, average crystal grain diameter, and aspect ratio and average C concentration of retained austenite of each of the metal phases can be adjusted by specifying the component composition and controlling the steel sheet structure during hot-rolling and/or continuous annealing.

Next, the method of producing a high-strength cold-rolled steel sheet is described.

The production method includes hot-rolling a steel slab having the component composition (chemical composition) described above under the conditions including a hot-rolling start temperature of 1150° C. to 1300° C. and a finishing temperature of 850° C. to 950° C.; starting cooling within 1 second after the finish of hot rolling and performing primary cooling to 650° C. or less at an average cooling rate of 80° C./s or more and then performing secondary cooling to 550° C. or less at an average cooling rate of 5° C./s or more; and coiling, pickling, cold-rolling, and then continuously annealing the steel sheet, wherein the continuous annealing includes heating to a temperature of 750° C. to 850° C. at an average heating rate of 3 to 30° C./s, holding (first soaking) at 750° C. to 850° C. for 30 seconds or more, cooling to a cooling stop temperature of 100° C. to 250° C. at an average cooling rate of 3° C./s or more, then heating to a temperature of 350° C. to 500° C., holding (second soaking) at 350° C. to 500° C. for 30 seconds or more, and then cooling to room temperature. In this case, the room temperature represents −5° C. to 40° C.

Hot-Rolling Step

The steel slab subjected to hot-rolling is preferably produced by a continuous casting method from the viewpoint of little producing macro-segregation of a component, but may be produced by an ingot casting method or a thin slab casting method. Examples of a process of supplying the steel slab to the hot-rolling step include a process in which the steel slab temporarily cooled to room temperature is re-heated and rolled, and energy-saving processes which can be applied without any problem, such as (i) a process in which the cast steel slab is charged to a heating furnace in a state of being a warm slab without being cooled, and reheated and rolled, (ii) a process in which the cast steel slab is kept warm without being cooled and is then immediately rolled, (iii) a process (hot direct rolling/direct rolling method) in which the cast steel slab is directly rolled and the like.

Hot-Rolling Start Temperature: 1150° C. to 1300° C.

The hot-rolling start temperature of less than 1150° C. increases the rolling load and thus decreases productivity, while the hot-rolling start temperature exceeding 1300° C. increases the heating cost, and thus the hot-rolling start temperature is 1150° C. to 1300° C. To start the hot-rolling at the temperature described above, the cast steel slab is supplied to the hot-rolling step through the process described above.

Finishing Temperature: 850° C. to 950° C.

Hot-rolling is required to be finished in an austenite single-phase region to improve elongation and hole expansion formability after annealing due to homogenization of the structure in the steel sheet and reduction in anisotropy of the material and, thus, the finishing temperature is 850° C. or more. On the other hand, the finishing temperature exceeding 950° C. coarsens the hot-rolled structure and thus decreases the characteristics after annealing. Therefore, the finishing temperature is 850° C. to 950° C.

Cooling conditions after finish rolling: starting cooling within 1 second after the finish of hot rolling, primary cooling to a cooling temperature of 650° C. or less at an average cooling rate of 80° C./s or more, secondary cooling to a cooling temperature of 550° C. or less at an average cooling rate of 5° C./s or more After the finish of hot-rolling, the steel structure of the hot-rolled steel sheet is controlled by cooling to a temperature range for bainite transformation without causing ferrite transformation. Controlling the homogenized hot-rolled structure can cause the effect of refining the final hot-rolled sheet structure, mainly ferrite and martensite. Therefore, after finish rolling, cooling is started within 1 second after the finish of rolling, and primary cooling is performed to 650° C. or less at an average cooling rate of 80° C./s or more. The primary cooling at an average cooling rate of less than 80° C./s starts ferrite transformation and thus makes the steel sheet structure of the hot-rolled steel sheet inhomogeneous, thereby decreasing the hole expansion formability after annealing. In addition, when the cooling temperature of primary cooling exceeds 650° C., pearlite is excessively produced and, in this case, the steel sheet structure of the hot-rolled steel sheet becomes inhomogeneous, thereby decreasing the hole expansion formability after annealing. Further, when primary cooling is started 1 second or more after the finish of rolling, ferrite or pearlite is excessively produced, thereby decreasing the hole expansion formability after annealing.

After the primary cooling, secondary cooling is performed to 550° C. or less at an average cooling rate of 5° C./s or more. When the average cooling rate in the secondary cooling is less than 5° C./s or the cooling temperature exceeds 550° C., ferrite or pearlite is excessively produced in the steel sheet structure of the hot-rolled steel sheet, thereby decreasing the hole expansion formability after annealing.

Coiling Temperature: 550° C. or less

The coiling temperature is inevitably 550° C. or less because as described above, the secondary cooling temperature is 550° C. or less, and the coiling temperature of 550° C. or less can prevent the excessive formation of ferrite and pearlite. The coiling temperature is preferably 500° C. or less. The lower limit of the coiling temperature is not particularly limited, but the excessively low coiling temperature induces excessive formation of hard martensite and increases the cold-rolling load, and thus the coiling temperature is preferably 300° C. or more.

Pickling Step

The hot-rolled steel sheet produced by hot-rolling is pickled to remove scales from the surface layer of the steel sheet. The pickling conditions are not particularly limited, and pickling may be performed according to a usual method.

Cold-Rolling Step

The hot-rolled steel sheet after pickling is cold-rolled to a predetermined thickness to produce a cold-rolled steel sheet. The cold-rolling conditions are not particularly limited, and cold-rolling may be performed according to a usual method.

Continuous Annealing Step

The cold-rolled steel sheet is continuously annealed to progress re-crystallization and form bainite, tempered martensite, and retained austenite, and martensite in the steel sheet structure to increase strength. The continuous annealing includes heating to a temperature of 750° C. to 850° C. at an average heating rate of 3 to 30° C./s, holding (first soaking) at 750° C. to 850° C. for 30 seconds or more, cooling to a cooling stop temperature of 100° C. to 250° C. at an average cooling rate of 3° C./s or more, then heating to a temperature of 350° C. to 500° C., holding (second soaking) at 350° C. to 500° C. for 30 seconds or more, and then cooling to room temperature.

Average Heating Rate at Start of Continuous Annealing: 3° C. to 30° C./s

The nucleation of ferrite and austenite produced by recrystallization in annealing occurs earlier than growth of the produced grains, that is, coarsening, and thus crystal grains after annealing can be refined. In particular, refining the ferrite grain diameter has the effect of increasing the yield ratio, and thus it is important to control the heating rate at the start of continuous annealing. Since recrystallization little proceeds by rapid heating, the upper limit of the average hating rate is 30° C./s. In addition, at an excessively low average heating rate, the predetermined average grain diameter cannot be obtained due to coarsening of the ferrite grains and, thus, the necessary average heating rate is 3° C./s or more. The average heating rate is preferably 5° C./s or more.

First Soaking Conditions: Soaking Temperature, 750° C. to 850° C., Holding (Soaking) Time, 30 Seconds or More In first soaking, soaking is performed within the temperature range of a ferrite-austenite two-phase region or an austenite single-phase region. With the soaking temperature of less than 750° C., the low volume fraction of austenite during annealing makes it impossible to obtain the volume fractions of bainite and tempered martensite at which the high yield ratio can be secured and, thus, the lower limit of the soaking temperature is 750° C. On the other hand, with the soaking temperature exceeding 850° C., the predetermined average grain diameter cannot be obtained due to coarsening of ferrite and austenite crystal grains and, thus, the upper limit of the soaking temperature is 850° C.

So that at the soaking temperature, recrystallization proceeds and the steel sheet is entirely or partially transformed to austenite, the necessary holding (soaking) time is 30 seconds or more. The upper limit of the holding (soaking) time is not particularly limited, but even holding for over 600 seconds causes no influence on the steel sheet structure and mechanical properties subsequently obtained, and thus the holding (soaking) time is 600 seconds or less from the viewpoint of energy saving.

Cooling Conditions After First Soaking: Average Cooling Rate, 3° C./s or More, Cooling Stop Temperature 100° C. to 250° C.

From the viewpoint of the high yield ratio and hole expansion formability, to produce tempered martensite, the austenite produced by first soaking is partially transformed to martensite by cooling from the soaking temperature to a temperature equal to or lower than the martensite transformation start temperature and, thus, cooling is performed to a cooling stop temperature of 100° C. to 250° C. at an average cooling rate of 3° C./s or more. At the average cooling rate of less than 3° C./s, pearlite and spherical cementite are excessively produced in the steel sheet structure and, thus, the lower limit of the average cooling rate is 3° C./s. The upper limit of the cooling rate is not particularly limited, but the average cooling rate is preferably 100° C./s or less to accelerate bainite transformation to some extent. In addition, with the cooling stop temperature of less than 100° C., martensite is excessively produced during cooling, and this decreases untransformed austenite and decreases bainite transformation and retained austenite, thereby decreasing elongation. On the other hand, with the cooling stop temperature exceeding 250° C., tempered martensite is decreased and, thus, hole expansion formability is decreased. Therefore, the cooling stop temperature is 100° C. to 250° C. The cooling stop temperature is preferably 150° C. or more. Also, the cooling stop temperature is preferably 220° C. or less. Second soaking conditions: soaking temperature, 350° C. to 500° C., holding (soaking) time, 30 seconds or more To produce tempered martensite by tempering the martensite produced during cooling and bainite and retained austenite in the steel sheet structure by transforming the untransformed austenite to bainite, the steel sheet is reheated after cooling in first soaking and held as second soaking at 350° C. to 500° C. for 30 seconds or more. The second soaking at the soaking temperature of less than 350° C. causes insufficient tempering of martensite and a large difference in hardness between ferrite and martensite, thereby degrading hole expansion formability. On the other hand, with the soaking temperature exceeding 500° C., pearlite is excessively produced, and thus the elongation is decreased. Therefore, the soaking temperature is 350° C. to 500° C. In addition, with the holding (soaking) time of less than 30 seconds, much untransformed austenite remains due to insufficient progress of bainite transformation, and finally martensite is excessively produced, thereby decreasing hole expansion formability. Therefore, the required holding (soaking) time is 30 seconds or more. The upper limit of the holding (soaking) time is not particularly limited, but even holding for over 2000 seconds causes no influence on the steel sheet structure and mechanical properties subsequently obtained, and thus the holding (soaking) time is 2000 seconds or less from the viewpoint of energy saving.

In addition, in the production method, temper rolling may be performed after continuous annealing. The elongation rate of the temper rolling is preferably 0.1 to 2.0%.

A hot-dip zinc-coated steel sheet may be formed by hot-dip galvanization in the annealing step. Also, an alloyed hot-dip zinc-coated steel sheet may be formed by alloying after hot-dip galvanization. Further, the cold-rolled steel sheet may be electro-coated to form an electro-coated steel sheet.

EXAMPLES

Steel having each of the chemical compositions shown in Table 1 was molten and cast into a slab having a thickness of 230 mm, and the steel slab was hot-rolled at a hot-rolling start temperature of 1250° C. under conditions shown in Table 2 and Table 3 to produce a hot-rolled steel sheet having a thickness of 3.2 mm. In the hot-rolling step, cooling was started within a predetermined time after the finish of finish rolling, primary cooling was performed to a predetermined cooling temperature at a predetermined average cooling rate, and then secondary cooling was performed to a predetermined cooling temperature (the same as the coiling temperature) at a predetermined average cooling rate, followed by coiling.

The resultant hot-rolled steel sheet was pickled and then cold-rolled to produce a cold-rolled steel sheet having a thickness of 1.4 mm. Then, continuous annealing was performed under conditions shown in Table 2 and Table 3. The continuous annealing included heating at a predetermined average heating rate, first soaking at a predetermined soaking temperature for a holding (soaking) time, cooling to a predetermined cooling stop temperature at a predetermined average cooling rate, then heating, second soaking at a predetermined soaking temperature for a holding (soaking) time, and then cooling to room temperature (25° C.).

A JIS No. 5 tensile test piece was obtained from the produced cold-rolled steel sheet so that the direction perpendicular to the rolling direction was the longitudinal direction (tensile direction), and yield strength (YS), tensile strength (TS), total elongation (EL), and yield ratio (YR) were measured by a tensile test (JIS Z2241 (1998)). A tensile strength (TS) of 980 MPa or more, a total elongation (EL) of 20.0% or more, and a yield ratio (YR) of 75% or more were determined to be "good".

With respect to hole expansion formability, according to the Japan iron and steel federation standards (JFS T1001 (1996)), a hole of 10 mm in diameter was punched in a sample with a clearance of 12.5%, the sample was set to a tester so that a burr faced the die side, and then hole expansion ratio λ (%) was measured by forming with a conical punch of 60°. When the hole expansion ratio λ (%) was 35% or more, hole expansion formability was determined to be "good".

With respect to the volume fractions of ferrite and martensite of the steel sheet, a thickness section of the steel sheet taken in parallel to the rolling direction was polished, corroded with 3% nital, and then observed with SEM (scanning electron microscope) at a magnification of each of 2,000 times and 5,000 times to measure an area ratio by a point count method (according to ASTM E562-83 (1988)), the area ratio being regarded as the volume fraction. With respect of the average crystal grain diameters of ferrite and martensite, the area of each of the phases can be calculated by using "Image-Pro" manufactured by Media Cybernetics, Inc. and taking a photograph of the steel sheet structure in which ferrite crystal grains were previously discriminated from martensite crystal grains, and the circle-equivalent diameters were calculated and averaged to determine each of the average grain diameters.

The steel sheet was polished to a ¼ thickness in the thickness direction and the volume fraction of retained austenite was determined from X-ray diffraction intensities of planes at the ¼ thickness. Specifically, the integrated intensities of X-ray diffraction lines of the {200} plane, {211} plane, and {220} plane of iron ferrite, and the {200} plane, {220} plane, and {311} plane of austenite were measured by an X-ray diffraction method (apparatus: "RINT2200" manufactured by Rigaku Corporation) using Mo-Kα line as a line source at an acceleration voltage of 50 keV, and the volume fraction of retained austenite was determined by using the measured values according to a calculation expression described in "X-ray Diffraction Handbook" (2000, Rigaku Denki Co., Ltd.) p. 26, 62-64. With respect to the average crystal grain diameter of retained austenite, a section was observed by using EBSD (electron back scatter diffraction method) at a magnification of 5000 times, and the circle-equivalent diameters were calculated by using the "Image-Pro" and averaged to determine the average grain diameter. With respect to the aspect ratio of retained austenite, the average aspect ratio of 10 positions was determined by observation with SEM (scanning electron microscope) and TEM (transmission electron microscope) at a magnification of each of 5000 times, 10000 times, and 20000 times. In Table 4 and Table 5, the retained austenite aspect ratio of 4 or more is denoted by "○" and the retained austenite aspect ratio of less than 4 is denoted by "×". The average C concentration ([Cγ %]) in retained austenite can be determined by calculation according to expression (2) in which the lattice constant a (Å) determined from the diffraction plane (220) of fcc iron using a CoKα line, [Mn %], and [Al %] were substituted:

$$a=3.578+0.033\,[C\gamma\ \%]+0.00095[Mn\ \%]+0.0056[Al\ \%] \quad (2)$$

wherein [Cγ %] is the average C concentration (% by mass) in retained austenite, and [Mn %] and [Al %] are contents (% by mass) of Mn and Al, respectively.

Also, the types of steel structures other than ferrite, retained austenite, martensite were determined by observing the steel sheet structure by SEM (scanning electron microscope), TEM (transmission electron microscope), and FE-SEM (field emission-scanning electron microscope). The average crystal grain diameter of a metal phase containing both bainite and tempered martensite was determined by calculating the circle-equivalent diameters from a photograph of the steel sheet using the "Image-Pro" and then averaging the values.

The metal structure of each of the steel sheet is shown in Table 4 and Table 5, and the measurement results of tensile characteristics and hole expansion ratio are shown in Table 6.

Table 6 indicates that in all our steel sheet examples, good processability such as an elongation of 20.0% or more and a hole expansion ratio of 35% or more can be obtained while a tensile strength of 980 MPa or more and a yield ratio of 75% or more are secure. On the other hand, comparative examples are poor in at least one characteristic of tensile strength, yield ratio, elongation, and hole expansion ratio.

TABLE 1

| | Chemical composition (% by mass) | | | | | | | | | | |
|---|---|---|---|---|---|---|---|---|---|---|---|
| Steel type | C | Si | Mn | P | S | Al | N | Ti | B | Other component | Remarks |
| A | 0.20 | 1.53 | 2.21 | 0.01 | 0.002 | 0.03 | 0.002 | 0.012 | 0.0015 | — | Adaptable steel |
| B | 0.18 | 1.29 | 2.41 | 0.01 | 0.001 | 0.03 | 0.003 | 0.018 | 0.0016 | — | Adaptable steel |
| C | 0.22 | 1.70 | 2.10 | 0.01 | 0.001 | 0.03 | 0.003 | 0.013 | 0.0010 | — | Adaptable steel |
| D | 0.17 | 1.39 | 2.41 | 0.01 | 0.001 | 0.03 | 0.002 | 0.011 | 0.0020 | V: 0.02 | Adaptable steel |
| E | 0.20 | 1.59 | 2.02 | 0.01 | 0.002 | 0.03 | 0.002 | 0.006 | 0.0009 | Nb: 0.02 | Adaptable steel |
| F | 0.17 | 1.42 | 1.89 | 0.01 | 0.001 | 0.03 | 0.002 | 0.015 | 0.0018 | Cr: 0.20 | Adaptable steel |
| G | 0.18 | 1.22 | 2.01 | 0.01 | 0.001 | 0.04 | 0.005 | 0.022 | 0.0010 | Mo: 0.20 | Adaptable steel |
| H | 0.16 | 2.11 | 2.09 | 0.01 | 0.001 | 0.03 | 0.003 | 0.031 | 0.0027 | Cu: 0.10 | Adaptable steel |
| I | 0.18 | 1.26 | 2.63 | 0.01 | 0.002 | 0.03 | 0.002 | 0.015 | 0.0012 | Ni: 0.10 | Adaptable steel |
| J | 0.19 | 1.22 | 2.44 | 0.02 | 0.002 | 0.03 | 0.002 | 0.015 | 0.0022 | Ca: 0.0035 | Adaptable steel |
| K | 0.18 | 1.53 | 2.71 | 0.02 | 0.003 | 0.03 | 0.002 | 0.026 | 0.0029 | REM: 0.0028 | Adaptable steel |
| L | 0.09 | 1.33 | 2.85 | 0.01 | 0.002 | 0.03 | 0.002 | 0.031 | 0.0012 | — | Comparative Example |

TABLE 1-continued

| Steel type | Chemical composition (% by mass) C | Si | Mn | P | S | Al | N | Ti | B | Other component | Remarks |
|---|---|---|---|---|---|---|---|---|---|---|---|
| M | 0.16 | 0.94 | 2.66 | 0.01 | 0.002 | 0.02 | 0.002 | 0.011 | 0.0021 | — | Comparative Example |
| N | 0.17 | 1.95 | 1.68 | 0.01 | 0.002 | 0.03 | 0.003 | 0.015 | 0.0025 | — | Comparative Example |
| O | 0.18 | 1.03 | 3.28 | 0.02 | 0.002 | 0.03 | 0.003 | 0.024 | 0.0012 | — | Comparative Example |
| P | 0.18 | 1.45 | 2.68 | 0.02 | 0.003 | 0.03 | 0.003 | — | — | — | Comparative Example |

* Underline: Out of the range of the present invention

TABLE 2

| No. | Steel type | Hot-rolling condition: Finishing temperature (° C.) | Time to start of cooling after finish rolling (second) | Primary cooling average cooling rate (° C./s) | Primary cooling temperature (° C.) | Secondary cooling average cooling rate (° C./s) | Coiling temperature (° C.) | Annealing condition: Average heating rate (° C./s) |
|---|---|---|---|---|---|---|---|---|
| 1 | A | 900 | 0.5 | 100 | 600 | 20 | 470 | 10 |
| 2 | B | 900 | 0.5 | 100 | 620 | 20 | 470 | 15 |
| 3 | C | 900 | 0.5 | 100 | 600 | 30 | 450 | 10 |
| 4 | D | 900 | 0.5 | 150 | 600 | 20 | 450 | 12 |
| 5 | E | 900 | 0.5 | 100 | 580 | 20 | 470 | 15 |
| 6 | F | 900 | 0.5 | 100 | 600 | 30 | 450 | 10 |
| 7 | G | 900 | 0.5 | 100 | 550 | 20 | 470 | 10 |
| 8 | H | 900 | 0.5 | 100 | 600 | 20 | 500 | 5 |
| 9 | I | 900 | 0.5 | 100 | 600 | 20 | 470 | 3 |
| 10 | J | 900 | 0.5 | 100 | 600 | 20 | 470 | 9 |
| 11 | K | 900 | 0.5 | 100 | 600 | 20 | 450 | 6 |
| 12 | B | 900 | 0.5 | 50 | 600 | 20 | 500 | 10 |
| 13 | B | 900 | 0.5 | 100 | 750 | 25 | 500 | 10 |
| 14 | B | 900 | 0.5 | 100 | 600 | 2 | 500 | 10 |
| 15 | B | 900 | 0.5 | 85 | 620 | 20 | 650 | 10 |

| No. | Annealing condition: First soaking temperature (° C.) | First holding time (second) | Cooling rate after first soaking (° C./s) | Cooling stop temperature (° C.) | Second soaking temperature (° C.) | Second holding time (second) | Remarks |
|---|---|---|---|---|---|---|---|
| 1 | 825 | 350 | 10 | 200 | 400 | 600 | Invention Example |
| 2 | 800 | 240 | 4 | 220 | 400 | 300 | Invention Example |
| 3 | 780 | 400 | 6 | 150 | 380 | 500 | Invention Example |
| 4 | 800 | 350 | 10 | 180 | 380 | 1000 | Invention Example |
| 5 | 800 | 350 | 15 | 220 | 380 | 600 | Invention Example |
| 6 | 800 | 600 | 10 | 200 | 400 | 600 | Invention Example |
| 7 | 800 | 300 | 8 | 220 | 450 | 600 | Invention Example |
| 8 | 800 | 300 | 8 | 200 | 400 | 600 | Invention Example |
| 9 | 800 | 300 | 8 | 200 | 480 | 300 | Invention Example |
| 10 | 800 | 300 | 8 | 200 | 450 | 180 | Invention Example |
| 11 | 820 | 320 | 10 | 200 | 400 | 500 | Invention Example |
| 12 | 800 | 350 | 8 | 200 | 430 | 600 | Comparative Example |
| 13 | 800 | 300 | 6 | 220 | 450 | 600 | Comparative Example |
| 14 | 800 | 300 | 10 | 220 | 400 | 600 | Comparative Example |
| 15 | 800 | 300 | 7 | 200 | 400 | 600 | Comparative Example |

* Underline: Out of the range of the present invention

TABLE 3

| No. | Steel type | Hot-rolling condition: Finishing temperature (° C.) | Time to start of cooling after finish rolling (second) | Primary cooling average cooling rate (° C./s) | Primary cooling temperature (° C.) | Secondary cooling average cooling rate (° C./s) | Coiling temperature (° C.) | Annealing condition: Average heating rate (° C./s) |
|---|---|---|---|---|---|---|---|---|
| 16 | B | 900 | 0.5 | 100 | 600 | 20 | 500 | 1 |
| 17 | B | 900 | 0.5 | 100 | 600 | 20 | 450 | 10 |
| 18 | B | 900 | 0.5 | 100 | 600 | 20 | 450 | 10 |
| 19 | B | 900 | 0.5 | 100 | 600 | 20 | 450 | 10 |

TABLE 3-continued

| | | | | | | | | |
|---|---|---|---|---|---|---|---|---|
| 20 | B | 900 | 0.5 | 100 | 600 | 20 | 450 | 10 |
| 21 | B | 900 | 0.5 | 100 | 550 | 20 | 450 | 10 |
| 22 | B | 900 | 0.5 | 100 | 600 | 20 | 450 | 10 |
| 23 | B | 900 | 0.5 | 100 | 550 | 20 | 450 | 10 |
| 24 | B | 900 | 0.5 | 100 | 600 | 20 | 450 | 10 |
| 25 | L | 900 | 0.5 | 100 | 550 | 20 | 450 | 10 |
| 26 | M | 900 | 0.5 | 100 | 550 | 20 | 470 | 10 |
| 27 | N | 900 | 0.5 | 100 | 550 | 20 | 470 | 10 |
| 28 | O | 900 | 0.5 | 100 | 600 | 20 | 470 | 10 |
| 29 | P | 900 | 0.5 | 100 | 550 | 20 | 470 | 10 |

| | Annealing condition | | | | | | |
|---|---|---|---|---|---|---|---|
| No. | First soaking temperature (° C.) | First holding time (second) | Cooling rate after first soaking (° C./s) | Cooling stop temperature (° C.) | Second soaking temperature (° C.) | Second holding time (second) | Remarks |
| 16 | 800 | 300 | 5 | 200 | 400 | 600 | Comparative Example |
| 17 | 740 | 300 | 7 | 200 | 400 | 600 | Comparative Example |
| 18 | 900 | 300 | 10 | 200 | 400 | 600 | Comparative Example |
| 19 | 820 | 300 | 1 | 220 | 400 | 600 | Comparative Example |
| 20 | 820 | 250 | 7 | 300 | 500 | 600 | Comparative Example |
| 21 | 820 | 300 | 8 | 60 | 380 | 600 | Comparative Example |
| 22 | 820 | 300 | 8 | 200 | 550 | 600 | Comparative Example |
| 23 | 820 | 300 | 7 | 200 | 300 | 500 | Comparative Example |
| 24 | 820 | 250 | 7 | 200 | 400 | 10 | Comparative Example |
| 25 | 820 | 250 | 7 | 250 | 400 | 300 | Comparative Example |
| 26 | 800 | 300 | 6 | 200 | 450 | 500 | Comparative Example |
| 27 | 820 | 300 | 5 | 200 | 450 | 500 | Comparative Example |
| 28 | 800 | 300 | 7 | 200 | 400 | 300 | Comparative Example |
| 29 | 820 | 300 | 8 | 200 | 400 | 300 | Comparative Example |

* Underline: Out of the range of the present invention

TABLE 4

| | Steel sheet structure | | | | | | |
|---|---|---|---|---|---|---|---|
| | Ferrite | | Retained austenite | | | | Martensite |
| No. | Volume fraction (%) | Average grain diameter (μm) | Volume fraction (%) | Aspect ratio | Average grain diameter (μm) | Average C concentration (% by mass) | Volume fraction (%) |
| 1 | 38 | 4 | 9 | ○ | 1.2 | 0.71 | 4 |
| 2 | 41 | 4 | 8 | ○ | 1.5 | 0.70 | 3 |
| 3 | 37 | 5 | 10 | ○ | 1.2 | 0.78 | 3 |
| 4 | 41 | 5 | 7 | ○ | 1.4 | 0.76 | 5 |
| 5 | 36 | 5 | 7 | ○ | 1.6 | 0.69 | 6 |
| 6 | 35 | 5 | 7 | ○ | 1.3 | 0.70 | 5 |
| 7 | 43 | 5 | 9 | ○ | 1.3 | 0.72 | 4 |
| 8 | 40 | 4 | 8 | ○ | 1.5 | 0.73 | 5 |
| 9 | 40 | 5 | 7 | ○ | 1.6 | 0.77 | 3 |
| 10 | 44 | 5 | 8 | ○ | 1.4 | 0.68 | 4 |
| 11 | 42 | 5 | 8 | ○ | 1.5 | 0.76 | 3 |
| 12 | 44 | 4 | 7 | ○ | 1.3 | 0.71 | 3 |
| 13 | 40 | 4 | 7 | ○ | 1.2 | 0.68 | 4 |
| 14 | 41 | 5 | 8 | ○ | 1.0 | 0.70 | 3 |
| 15 | 40 | 5 | 7 | ○ | 1.6 | 0.71 | 4 |

| | Steel sheet structure | | | | | |
|---|---|---|---|---|---|---|
| | Martensite | Balance structure | | | | |
| No. | Average grain diameter (μm) | Type *1 | Average grain diameter (μm)*3 | TM volume fraction (%) | V2/V1 *2 | Remarks |
| 1 | 2 | B, TM | 5 | 42 | 0.68 | Invention Example |
| 2 | 1 | B, TM | 5 | 39 | 0.66 | Invention Example |
| 3 | 2 | B, TM | 6 | 39 | 0.62 | Invention Example |
| 4 | 2 | B, TM | 5 | 37 | 0.63 | Invention Example |
| 5 | 2 | B, TM | 4 | 47 | 0.73 | Invention Example |
| 6 | 1 | B, TM | 5 | 49 | 0.75 | Invention Example |
| 7 | 2 | B, TM | 5 | 41 | 0.72 | Invention Example |
| 8 | 1 | B, TM | 4 | 38 | 0.63 | Invention Example |
| 9 | 2 | B, TM | 4 | 40 | 0.67 | Invention Example |

TABLE 4-continued

| | | | | | | |
|---|---|---|---|---|---|---|
| 10 | 2 | B, TM | 5 | 36 | 0.64 | Invention Example |
| 11 | 2 | B, TM | 4 | 41 | 0.71 | Invention Example |
| 12 | 4 | B, TM | 4 | 35 | 0.63 | Comparative Example |
| 13 | 3 | B, TM | 4 | 38 | 0.63 | Comparative Example |
| 14 | 3 | B, TM | 5 | 38 | 0.64 | Comparative Example |
| 15 | 3 | B, TM | 4 | 40 | 0.67 | Comparative Example |

* Underline: Out of the range of the present invention
*1 B: Bainite, TM: Tempered martensite, P: Pearlite
*2 V1: Volume fraction of metal structures other than ferrite, V2: Volume fraction of tempered martensite
*3Average crystal grain diameter of metal phase containing both bainite and tempered martensite

TABLE 5

| | Steel sheet structure | | | | | | |
|---|---|---|---|---|---|---|---|
| | Ferrite | | Retained austenite | | | | Martensite |
| No. | Volume fraction (%) | Average grain diameter (μm) | Volume fraction (%) | Aspect ratio | Average grain diameter (μm) | Average C concentration (% by mass) | Volume fraction (%) |
| 16 | 37 | 7 | 7 | ○ | 1.5 | 0.72 | 3 |
| 17 | 72 | 9 | 3 | x | 0.7 | 0.74 | 2 |
| 18 | 11 | 3 | 5 | x | 2.6 | 0.61 | 5 |
| 19 | 58 | 7 | 4 | ○ | 1.1 | 0.51 | 4 |
| 20 | 33 | 6 | 9 | ○ | 1.2 | 0.68 | 12 |
| 21 | 35 | 5 | 3 | ○ | 1.5 | 0.59 | 2 |
| 22 | 40 | 5 | 3 | ○ | 1.6 | 0.57 | 4 |
| 23 | 38 | 6 | 7 | ○ | 1.8 | 0.61 | 11 |
| 24 | 39 | 5 | 7 | x | 1.2 | 0.62 | 13 |
| 25 | 40 | 5 | 7 | ○ | 1.5 | 0.57 | 2 |
| 26 | 38 | 4 | 4 | ○ | 1.5 | 0.60 | 5 |
| 27 | 59 | 7 | 3 | ○ | 1.6 | 0.65 | 2 |
| 28 | 35 | 5 | 10 | ○ | 1.6 | 0.66 | 11 |
| 29 | 35 | 4 | 16 | ○ | 2.4 | 0.61 | 7 |

| | Steel sheet structure | | | | | |
|---|---|---|---|---|---|---|
| | Martensite | Balance structure | | | | |
| No. | Average grain diameter (μm) | Type *1 | Average grain diameter (μm)*3 | TM volume fraction (%) | V2/V1 *2 | Remarks |
| 16 | 2 | B, TM | 8 | 44 | 0.70 | Comparative Example |
| 17 | 3 | B, TM | 4 | 11 | 0.39 | Comparative Example |
| 18 | 5 | B, TM | 5 | 78 | 0.88 | Comparative Example |
| 19 | 2 | B, TM, P | 8 | 28 | 0.67 | Comparative Example |
| 20 | 5 | B, TM | 5 | 23 | 0.34 | Comparative Example |
| 21 | 1 | B, TM | 8 | 59 | 0.91 | Comparative Example |
| 22 | 1 | B, TM, P | 4 | 39 | 0.65 | Comparative Example |
| 23 | 5 | B, TM | 5 | 39 | 0.63 | Comparative Example |
| 24 | 6 | B, TM | 4 | 39 | 0.64 | Comparative Example |
| 25 | 2 | B, TM | 4 | 46 | 0.77 | Comparative Example |
| 26 | 2 | B, TM | 5 | 40 | 0.65 | Comparative Example |
| 27 | 2 | B, TM | 5 | 27 | 0.66 | Comparative Example |
| 28 | 1 | B, TM | 4 | 41 | 0.63 | Comparative Example |
| 29 | 2 | B, TM | 4 | 40 | 0.62 | Comparative Example |

* Underline: Out of the range of the present invention
*1 B: Bainite, TM: Tempered martensite, P: Pearlite
*2 V1: Volume fraction of metal structure other than ferrite, V2: Volume fraction of tempered martensite
*3Average crystal grain diameter of metal phase containing both bainite and tempered martensite

TABLE 6

| | Tensile characteristic | | | | Hole expansion | |
|---|---|---|---|---|---|---|
| No. | YS (MPa) | TS (MPa) | EL (%) | YR (%) | ratio λ (%) | Remarks |
| 1 | 792 | 1044 | 23.2 | 76 | 38 | Invention Example |
| 2 | 795 | 1022 | 20.3 | 78 | 40 | Invention Example |
| 3 | 788 | 1023 | 24.1 | 77 | 39 | Invention Example |

TABLE 6-continued

| | Tensile characteristic | | | | Hole expansion | |
|---|---|---|---|---|---|---|
| No. | YS (MPa) | TS (MPa) | EL (%) | YR (%) | ratio λ (%) | Remarks |
| 4 | 805 | 1024 | 20.6 | 79 | 41 | Invention Example |
| 5 | 803 | 1051 | 20.3 | 76 | 40 | Invention Example |
| 6 | 811 | 1033 | 21.1 | 79 | 38 | Invention Example |

TABLE 6-continued

| No. | Tensile characteristic YS (MPa) | TS (MPa) | EL (%) | YR (%) | Hole expansion ratio λ (%) | Remarks |
|---|---|---|---|---|---|---|
| 7 | 812 | 1023 | 20.3 | 79 | 39 | Invention Example |
| 8 | 801 | 1029 | 20.4 | 78 | 40 | Invention Example |
| 9 | 795 | 1019 | 20.5 | 78 | 38 | Invention Example |
| 10 | 809 | 1029 | 20.1 | 79 | 39 | Invention Example |
| 11 | 799 | 1029 | 20.4 | 78 | 40 | Invention Example |
| 12 | 803 | 1022 | 20.3 | 79 | 26 | Comparative Example |
| 13 | 876 | 1031 | 17.6 | 85 | 22 | Comparative Example |
| 14 | 811 | 1065 | 18.8 | 76 | 19 | Comparative Example |
| 15 | 803 | 1021 | 19.1 | 79 | 30 | Comparative Example |
| 16 | 811 | 1045 | 18.1 | 78 | 32 | Comparative Example |
| 17 | 710 | 901 | 20.9 | 79 | 33 | Comparative Example |
| 18 | 781 | 1089 | 15.1 | 72 | 40 | Comparative Example |
| 19 | 688 | 891 | 17.8 | 77 | 29 | Comparative Example |
| 20 | 623 | 1015 | 20.3 | 61 | 15 | Comparative Example |
| 21 | 889 | 1022 | 15.6 | 87 | 53 | Comparative Example |
| 22 | 834 | 1013 | 15.9 | 82 | 30 | Comparative Example |
| 23 | 682 | 1003 | 21.1 | 68 | 18 | Comparative Example |
| 24 | 669 | 1038 | 19.5 | 64 | 19 | Comparative Example |
| 25 | 881 | 1058 | 17.1 | 83 | 75 | Comparative Example |
| 26 | 801 | 1033 | 16.9 | 78 | 18 | Comparative Example |
| 27 | 702 | 995 | 19.1 | 71 | 31 | Comparative Example |
| 28 | 651 | 1059 | 18.8 | 61 | 21 | Comparative Example |
| 29 | 597 | 1042 | 24.6 | 57 | 26 | Comparative Example |

* Underline: Out of the intended range

The invention claimed is:

1. A high-yield-ratio high-strength cold-rolled steel sheet having a steel composition comprising, by % by mass, 0.15 to 0.25% of C, 1.2 to 2.2% of Si, 1.8 to 3.0% of Mn, 0.08% or less of P, 0.005% or less of S, 0.01 to 0.08% of Al, 0.007% or less of N, 0.005 to 0.050% of Ti, 0.0003 to 0.0050% of B, and the balance composed of Fe and inevitable impurities, wherein the steel sheet has a composite structure having a ferrite volume fraction of 20% to 50%, a retained austenite volume fraction of 7% to 20%, a martensite volume fraction of 1% to 8%, and the balance containing bainite and tempered martensite, and in the composite structure, ferrite has an average crystal grain diameter of 5 μm or less, retained austenite has an average crystal grain diameter of 0.3 to 2.0 μm and an aspect ratio of 4 or more, martensite has an average crystal grain diameter of 2 μm or less, a metal phase containing both bainite and tempered martensite has an average crystal grain diameter of 7 μm or less, a volume fraction (V1) of a metal structure other than ferrite and a volume fraction (V2) of tempered martensite satisfy expression (1), and an average C concentration in retained austenite is 0.65% by mass or more $$0.60 \leq V2/V1 \leq 0.85 \quad (1).$$

2. The steel sheet according to claim 1, further comprising, by % by mass, at least one selected from the group consisting of 0.10% or less of V, 0.10% or less of Nb, 0.50% or less of Cr, 0.50% or less of Mo, 0.50% or less of Cu, 0.50% or less of Ni, 0.0050% or less of Ca, and 0.0050% or less of REM.

3. A method of producing a high-yield-ratio high-strength cold-rolled steel sheet comprising:

hot-rolling a steel slab having the chemical composition according to claim 1 under conditions including a hot-rolling start temperature of 1150° C. to 1300° C. and a finishing temperature of 850° C. to 950° C.;

starting cooling within 1 second after finishing hot rolling and performing primary cooling to 650° C. or less at an average cooling rate of 80° C./s or more and then performing secondary cooling to 550° C. or less at an average cooling rate of 5° C./s or more; and coiling, pickling, cold-rolling and then continuously annealing the steel sheet, wherein the continuous annealing includes heating to a temperature of 750° C. to 850° C. at an average heating rate of 3 to 30° C./s, holding at temperature of 750° C. to 850° C. for 30 seconds or more, cooling to a cooling stop temperature of 100° C. to 250° C. at an average cooling rate of 3° C./s or more, then heating to a temperature of 350° C. to 500° C., holding at temperature of 350° C. to 500° C. for 30 seconds or more, and then cooling to room temperature.

4. A method of producing a high-yield-ratio high-strength cold-rolled steel sheet comprising:

hot-rolling a steel slab having the chemical composition according to claim 2 under conditions including a hot-rolling start temperature of 1150° C. to 1300° C. and a finishing temperature of 850° C. to 950° C.;

starting cooling within 1 second after finishing hot rolling and performing primary cooling to 650° C. or less at an average cooling rate of 80° C./s or more and then performing secondary cooling to 550° C. or less at an average cooling rate of 5° C./s or more; and coiling, pickling, cold-rolling and then continuously annealing the steel sheet, wherein the continuous annealing includes heating to a temperature of 750° C. to 850° C. at an average heating rate of 3 to 30° C./s, holding at temperature of 750° C. to 850° C. for 30 seconds or more, cooling to a cooling stop temperature of 100° C. to 250° C. at an average cooling rate of 3° C./s or more, then heating to a temperature of 350° C. to 500° C., holding at temperature of 350° C. to 500° C. for 30 seconds or more, and then cooling to room temperature.

5. The high-yield-ratio high-strength cold-rolled steel sheet according to claim 1, wherein the average C concentration in retained austenite is 0.78% by mass or less.

6. The high-yield-ratio high-strength cold-rolled steel sheet according to claim 2, wherein the average C concentration in retained austenite is 0.78% by mass or less.

7. A method for producing a high-yield-ratio high-strength cold-rolled steel sheet comprising hot-rolling a steel slab having the chemical composition according to claim 5 under the conditions including a hot-rolling start temperature of 1150° C. to 1300° C. and a finishing temperature of 850° C. to 950° C.; starting cooling within 1 second after the finish of hot rolling and performing primary cooling to 650° C. or less at an average cooling rate of 80° C./s or more and then performing secondary cooling to 550° C. or less at an average cooling rate of 5° C./s or more; and coiling, pickling, cold-rolling, and then continuously annealing the steel sheet, wherein the continuous annealing includes heating to a temperature range of 750° C. to 850° C. at an average heating rate of 3 to 30° C./s, holding in the temperature range of 750° C. to 850° C. for 30 seconds or more, cooling to a cooling stop temperature range of 100° C. to 250° C. at an average cooling rate of 3° C./s or more, then heating to a temperature range of 350° C. to 500° C., holding in the temperature range of 350° C. to 500° C. for 30 seconds or more, and then cooling to room temperature.

8. A method for producing a high-yield-ratio high-strength cold-rolled steel sheet comprising hot-rolling a steel slab having the chemical composition according to claim 6 under the conditions including a hot-rolling start temperature of 1150° C. to 1300° C. and a finishing temperature of 850° C. to 950° C.; starting cooling within 1 second after the finish of hot rolling and performing primary cooling to 650° C. or less at an average cooling rate of 80° C./s or more and then performing secondary cooling to 550° C. or less at an average cooling rate of 5° C./s or more; and coiling, pickling, cold-rolling, and then continuously annealing the steel sheet, wherein the continuous annealing includes heating to a temperature range of 750° C. to 850° C. at an average heating rate of 3 to 30° C./s, holding in the temperature range of 750° C. to 850° C. for 30 seconds or more, cooling to a cooling stop temperature range of 100° C. to 250° C. at an average cooling rate of 3° C./s or more, then heating to a temperature range of 350° C. to 500° C., holding in the temperature range of 350° C. to 500° C. for 30 seconds or more, and then cooling to room temperature.

* * * * *